US005730502A

United States Patent [19]

Montgomery, Jr.

[11] Patent Number: 5,730,502

[45] Date of Patent: Mar. 24, 1998

[54] CUTTING TOOL SLEEVE ROTATION LIMITATION SYSTEM

[75] Inventor: Robert H. Montgomery, Jr., Everett, Pa.

[73] Assignee: Kennametal Inc., Latrobe, Pa.

[21] Appl. No.: 769,405

[22] Filed: Dec. 19, 1996

[51] Int. Cl.[6] ..... E21C 35/197

[52] U.S. Cl. ..... 299/104; 299/107

[58] Field of Search ..... 299/104, 106, 299/107, 109; 775/354

[56] References Cited

U.S. PATENT DOCUMENTS

| | | | |
|---|---|---|---|
| 3,466,772 | 9/1969 | Phillips | 299/109 X |
| 3,519,309 | 7/1970 | Engle et al. | 299/107 |
| 3,652,130 | 3/1972 | Elders | 299/106 |
| 3,697,137 | 10/1972 | Krekeler | 299/106 |
| 3,749,449 | 7/1973 | Krekeler | 299/102 |
| 4,201,421 | 5/1980 | Den Besten et al. | 299/107 |
| 4,462,638 | 7/1984 | DenBesten | 299/104 |
| 4,484,783 | 11/1984 | Emmerich | 299/107 |
| 4,603,911 | 8/1986 | Hindmarch et al. | 299/104 |
| 4,650,254 | 3/1987 | Wechner | 299/102 |
| 4,813,501 | 3/1989 | Mills et al. | 175/335 |
| 4,893,875 | 1/1990 | Lonn et al. | 299/113 |
| 4,911,504 | 3/1990 | Stiffler et al. | 299/113 |
| 5,011,229 | 4/1991 | O'Neill et al. | 299/102 |
| 5,040,850 | 8/1991 | Komotzki | 299/106 |
| 5,067,775 | 11/1991 | D'Angelo | 299/104 |
| 5,098,167 | 3/1992 | Latham | 299/104 |
| 5,273,343 | 12/1993 | Ojanen | 299/10 |
| 5,303,984 | 4/1994 | Ojanen | 299/106 |
| 5,503,463 | 4/1996 | Ojanen | 299/107 |
| 5,605,382 | 2/1997 | Massa | 299/107 |
| 5,607,206 | 3/1997 | Siddle et al. | 299/102 |
| 5,628,549 | 5/1997 | Ritchey et al. | 299/104 |

*Primary Examiner*—David J. Bagnell
*Attorney, Agent, or Firm*—John J. Prizzi

[57] ABSTRACT

A tool sleeve rotation limitation system for reducing the rotation of a tool sleeve within a support block bore of a support block, the tool sleeve having a forward portion and a rearward portion. The tool sleeve rotation limitation system comprises a rotation limitation member located in an engaging relationship between the rearward portion of the tool sleeve and the block bore such that the rotation limitation member will be moved axially along the rearward portion of the tool sleeve as the tool sleeve is inserted into the block bore so as to engage the block bore and the rearward portion of the tool sleeve and reduce rotation of the tool sleeve within the block bore.

20 Claims, 4 Drawing Sheets

CUTTING TOOL SLEEVE ROTATION LIMITATION SYSTEM

TECHNICAL FIELD

This invention relates to excavation cutting tools, and more particularly, to a rotation limitation system for reducing the rotation of a cutting tool sleeve within a support block.

BACKGROUND ART

Cutting tool assemblies for such applications as continuous mining, excavating, or road milling typically comprise a cutting tool, sometimes called a cutting bit, rotatably mounted within a support block. The support block in turn is mounted onto a drum or other body, typically by welding, which in turn is driven by a suitable drive mechanism. When a number of such support blocks carrying cutting tools are mounted onto a drum, and the drum is driven, the cutting tools will engage and break up the material which is sought to be mined or removed. The general operation of such a mining, excavating, or road milling machine is well known in the art.

Because the support block is exposed, it is subject to wear and abuse and must be cut or torched off the drum and replaced when unusable. In order to prolong the life of the support block, a cutting tool sleeve, sometimes referred to as a bit sleeve, tool holder, or bit holder, is sometimes employed. The cutting tool is mounted within the tool sleeve which in turn is mounted within the support block. The tool sleeve generally has an outer wear surface which helps to protect the support block from abuse and wear during use, thus minimizing the down time otherwise required for support block replacement and drum repair. The use of such tool sleeves is well known in the art.

For example, U.S. Pat. No. 5,067,775 to D'Angelo, hereby incorporated by reference in its entirety, discloses the use of a tool sleeve. More specifically, and as illustrated in FIGS. 1, 2 and 3 of the D'Angelo patent, the tool sleeve has a larger diameter forward portion and a smaller diameter rearward portion joined by an inclined region. When inserted into the bore of a support block, the smaller diameter rearward portion of the sleeve extends out of the back of the block and has a groove in which a retainer member is mounted. The inclined region of the tool sleeve fits against an inclined region of the tool block such that the sleeve is held in the block with a slight degree of axial movement freedom. The sleeve is also relatively freely rotatable in the support block. The sleeve, of course, includes a tool bore into which a cutting tool may be rotatably or otherwise mounted. Because the larger diameter forward portion of the sleeve protrudes from the cutting block, it bears the brunt of any abusive wear to which the support block would otherwise be subjected.

Many typical tool sleeve retention systems, such as the one disclosed in the D'Angelo patent, allow the tool sleeve to rotate within the support block. In typical mining or road milling applications, especially those involving abrasive materials, dust, dirt or other debris may get into the support block bore, or otherwise between the tool sleeve and support block, and cause excessive wear to both the tool sleeve and the support block.

Various methods have been proposed or used in the past to limit or prevent rotation of a tool sleeve within a support block.

An example is shown in FIG. 1 which is an isometric view of a prior art steel clip 10 having a wavy configuration with inner apexes 12 and outer apexes 14 which was made by Kennametal Inc., Latrobe, Pa. As shown in FIG. 2, this steel clip 10 was used with a tool sleeve 16 having a clip groove 18. More specifically, the steel clip 10 was used by placing it within the clip groove 18 as shown in FIG. 2 before inserting the tool sleeve 16 within a support block bore. The clip groove 18 was located along the longitudinal length of the tool sleeve 16 such that it would be located within the support block bore when the tool sleeve 16 was fully inserted. As a result, the steel clip 10 would be compressed within the support block bore and the inner apexes 12 and outer apexes 14 would frictionally engage both the clip groove 16 of the tool sleeve 18 and the support block bore to reduce rotation of the tool sleeve 18 relative to the support block. However, such prior steel clips 10 would sometimes fail during use as the result of wear or fatigue, especially of the inner apexes 12 or outer apexes 14, making the clips 10 unable to fulfill the function of minimizing rotation of the tool sleeve 16 within the support block bore.

SUMMARY OF THE INVENTION

An object of the present invention is to provide an improved rotation limitation system for reducing the rotation of a tool sleeve within a support block bore.

In carrying out the above object, and other objects and features of this invention, an improved tool sleeve rotation limitation system is provided for reducing the rotation of a tool sleeve within a block bore of a support block, the tool sleeve having a forward portion and a rearward portion. The tool sleeve rotation limitation system comprises a rotation limitation member located in an engaging relationship between the rearward portion of the tool sleeve and the block bore such that the rotation limitation member will be moved axially along the rearward portion of the tool sleeve as the tool sleeve is inserted into the block bore so as to engage the block bore and the rearward portion of the tool sleeve and reduce rotation of the tool sleeve within the block bore.

In another embodiment, the tool sleeve rotation limitation system comprises a sleeve body having a sleeve recess and a rotation limitation member located in an engaging relationship between the sleeve recess of the tool sleeve and the block bore such that the rotation limitation member will be moved axially within the sleeve recess as the tool sleeve is inserted into the block bore so as to engage the sleeve recess of the tool sleeve in the block bore and reduce rotation of the tool sleeve within the block bore.

In more specific embodiments, the sleeve recess is an annular depression. Even more specifically, the sleeve body may have a forward portion and a rearward portion and the annular depression may be located in the rearward portion. Furthermore, the annular depression may have an inclined surface portion such that the rotation limitation member will be moved axially within the annular depression along the inclined surface portion as the tool sleeve is inserted into the block bore and be compressed between the block bore and the rearward portion of the tool sleeve so as to reduce rotation of the tool sleeve within the block bore. The inclined surface portion may be a frusto-conical portion.

In another more specific embodiment, the annular depression may have a cylindrical portion and a frusto-conical portion, the cylindrical portion being closer to the forward portion than the frusto-conical portion and the frusto-conical portion having a large diameter dimension closer to the forward portion, such that the rotation limitation member will be moved axially within the annular depression and along the frusto-conical portion as to the tool sleeve is inserted into the block bore and be compressed between the annular depression and the block bore so as to reduce rotation of the tool sleeve within the block bore.

In all of these embodiments, the rotation limitation member may be made from a resilient material and may have an O-ring configuration. Furthermore, the rotation limitation member may protrude out of the annular depression such that the rotation limitation member will engage the block bore when the tool sleeve is inserted within the block bore.

In another embodiment of this invention, an improved tool sleeve is provided for use with a rotation limitation member so as to reduce the rotation of the tool sleeve within a support block bore of a support block. The tool sleeve comprises a tool sleeve body having a forward portion and a rearward portion, the rearward portion having an annular depression which has an inclined surface portion such that a rotation limitation member located within the annular depression will protrude from and engage the block bore as the tool sleeve is inserted into the block bore such that the rotation limitation member will be moved axially along the inclined surface portion and be compressed between the annular depression and the block bore so as to reduce rotation of the tool sleeve within the block bore.

In more specific embodiments, the inclined surface portion is a frusto-conical portion. In another even more specific embodiment, the annular depression may include a cylindrical portion. The cylindrical portion may be closer to the forward portion of the tool sleeve than the frusto-conical portion and the frusto-conical portion may have a large diameter dimension closer to the forward portion. Furthermore, the annular depression may have sidewalls which are radiused.

The advantages resulting from the present invention are numerous. First, the invention allows cutting tool sleeves to be mounted within the block bore of a support block such that rotation of the tool sleeve within the support block will be reduced. This will cut down on abrasive wear between the tool sleeve and the support block which might otherwise occur due to abrasive materials, dust, dirt or other debris between the tool sleeve and the support block.

Furthermore, if the rotation limitation member is resilient, it will be less susceptible to wear or fatigue failure. Additionally, if the rotation limitation member is resilient, it will typically have a co-efficient of friction such that rotation of the tool sleeve within the block bore will be reduced to a higher extent than would otherwise be the case.

Also, because the rotation limitation member may be compressed between the tool sleeve and the block bore, the frictional forces will be increased and rotation of the tool sleeve within the block bore will be reduced even further.

An additional advantage is that the tool sleeve may typically be converted to a normally rotatable configuration relative to the support block by simply not using the rotation limitation member.

Further objects and advantages of this invention will be apparent from the following description, reference being had to the accompanying drawings wherein various embodiments of the present invention are shown.

BRIEF DESCRIPTION OF THE DRAWINGS

While various embodiments of the invention are illustrated, the particular embodiments shown should not be construed to limit the claims. It is anticipated that various changes and modifications may be made without departing from the scope of this invention.

BEST MODE FOR CARRYING OUT THE INVENTION

Figure 3:
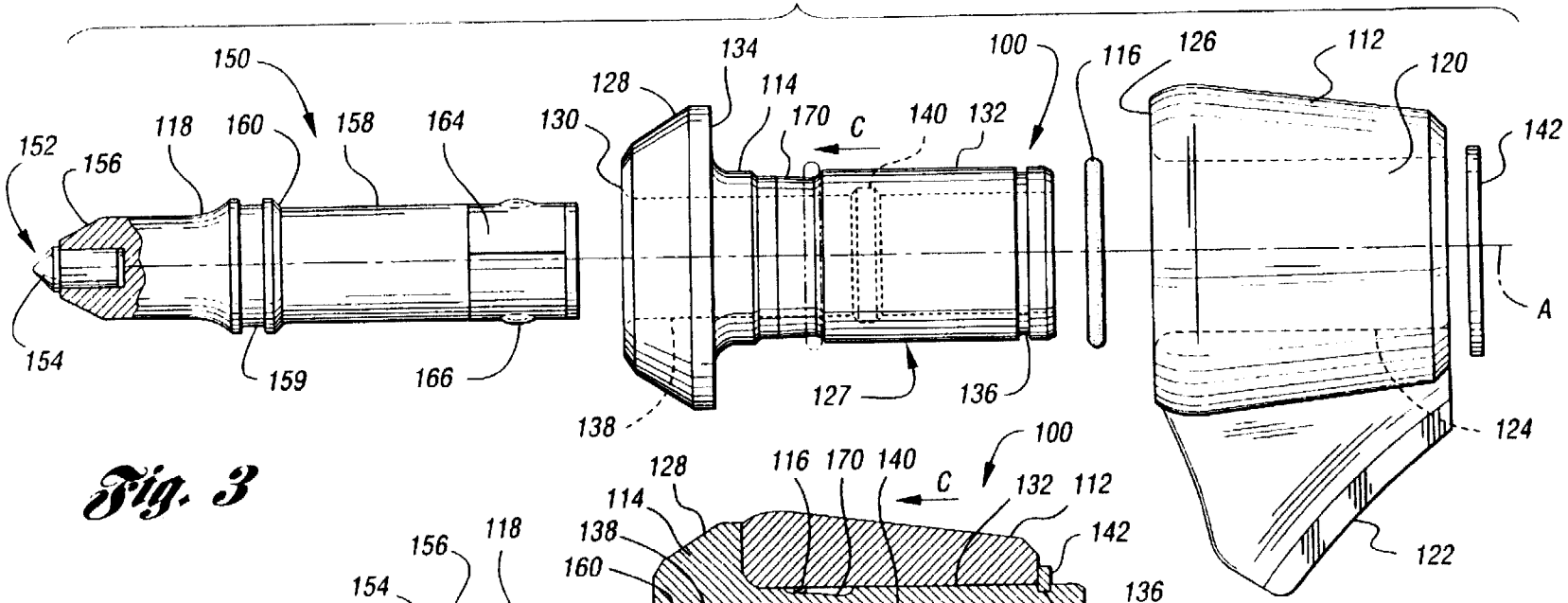
FIG. 3 is an exploded side elevational view showing a cutting tool, a support sleeve, a rotation limitation member, a support block, and a retainer ring according to one embodiment of this invention.
Figure 4:
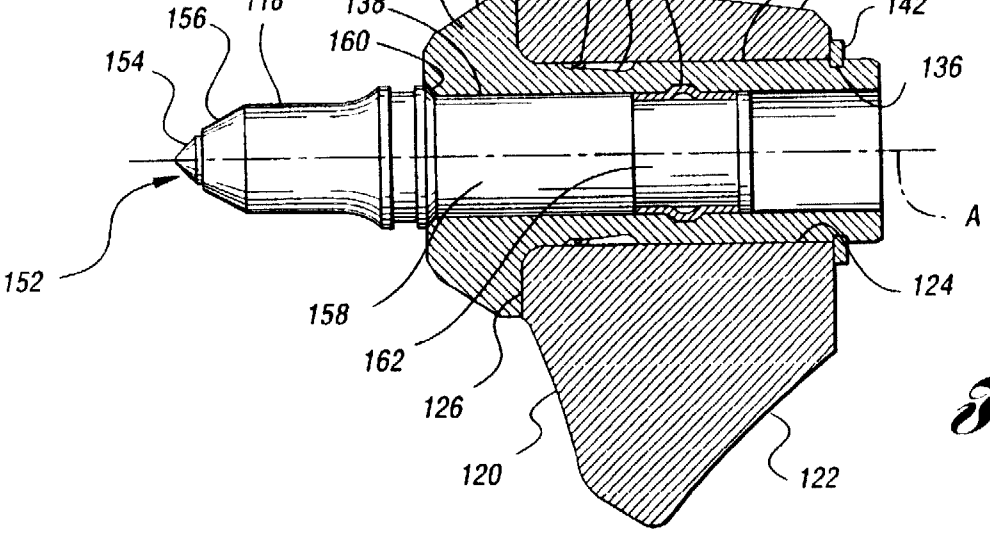
FIG. 4 is a side elevational view partly in section showing the assembled components of FIG. 3.

One embodiment of the tool sleeve rotation limitation system 100 is shown in FIGS. 3 and 4. The tool sleeve rotation limitation system 100 includes a support block 112, a tool sleeve 114, a sleeve rotation limitation member 116 and a cutting tool 118. In the embodiment shown, the cutting tool 118 may be mounted within the tool sleeve 114 which in turn may be mounted within the support block 112.

Such support blocks 112 typically have an exterior block surface 120 of which a portion is a block base 122. Such support blocks 112 also typically have a block bore 124 surrounded at the exterior block surface 120 by a seating shoulder region 126. Such support blocks are well known in the art and may have an infinite variety of configurations and dimensions.

In use, such support blocks 112 may be distributed over, and the block bases 122 may be welded or otherwise connected to, the circumference and length of a drum or other body (not shown) according to any desired pattern. While the block base 122 has been shown as comprising a curved surface for welding or otherwise connecting the support block 112 to the surface of a drum or the like, it will be understood that the support block could be shaped for mounting to any desired body, such as a chain link or any other suitable supporting or driving device. The drum or other body may be driven by any conventional or suitable drive mechanism to cause the cutting tools 118 to engage and break up material to which they are applied. Such applications are well known in the art.

Seated in the block bore 124 is the tool sleeve 114. The tool sleeve 114 has a sleeve body 127 which has a longitudinal axis "A". The sleeve body 127 has a large forward portion 128 which may have a generally conical shape as shown, the forwardmost portion of which comprises a sleeve seating region 130. The tool sleeve 114 also has a smaller diameter rearward portion 132 joined to the large forward portion 128 at a sleeve shoulder 134. The rearward portion 132, as shown in this embodiment, has a retainer groove 136.

Additionally, the tool sleeve 114 typically has a sleeve bore 138 which may, as shown in FIGS. 3 and 4, define a bore groove 140. Such tool sleeves are well known in the art and may have an infinite variety of configurations and dimensions.

As shown in FIG. 4, when the rearward portion 132 of the tool sleeve 114 is inserted into the block bore 124 such that the retainer groove 136 is exposed and the sleeve shoulder 134 abuts or is in close proximity to the seating shoulder region 126 of the support block 112, a retainer ring 142 may be placed within the retainer groove 136 to prevent the tool sleeve 114 from being dislodged from the block bore 124 during use. The use of such retainer rings is generally known in the art. Alternatively, other methods for mounting the tool sleeve within the block bore 124 of a support block 112 may be used. For example, another method of mounting utilizing multiple collar members and a snap ring is disclosed in U.S. Pat. No. 5,067,775, to D'Angelo.

The cutting tool 118 typically has an elongated tool body 150. The cutting end 152 of the cutting tool 118 typically comprises a hard cutting insert 154 mounted onto a generally tapering outer region 156. This hard cutting insert 154 may be made from cemented tungsten carbide or any other suitable material. The hard cutting insert 154 is generally mounted at the end of the generally tapering outer region 156 where the cutting insert 154 may be brazed or otherwise suitably fastened into place. The cutting tool 118 also includes a tool shank 158 adjoining the outer region 156 at an annular tool groove 159 which is flared out to form a tool shoulder 160. The annular tool groove 159 is for the purpose of receiving a tool for removing the cutting tool 118 from the tool sleeve 114 when the cutting tool 118 is to be changed.

The tool shank 158 has an annular keeper groove 162 in which is seated a keeper member. The keeper member in the embodiment shown is a split ring band 164 having dimples or protuberances 166 distributed about the periphery of the split ring band 164. The keeper groove 162 and the protuberances 166 of the split ring band 164 are located along the tool shank 158 such that when the cutting tool 118 is inserted into the sleeve bore 138, as shown in FIG. 4, the protuberances 166 will snap into the bore groove 140 so as to retain the cutting tool 118 in an assembled relation with the tool sleeve 114. The keeper member in the form of split ring band 164 will yield inwardly in the sleeve bore 138 so as to permit the cutting tool 118 to be pushed into the sleeve bore 138 and will then snap outwardly into the bore groove 140 when the cutting tool 118 is completely seated in the sleeve bore 138. The split ring band 164 retains the cutting tool 118 in the tool sleeve 114 and permits a slight amount of axial movement of the cutting tool 118 in the sleeve bore 138 so that the tool shoulder 160 of the cutting tool 118 is not locked against the sleeve seating region 130 and the cutting tool 118 is rotatable within the sleeve bore 138. Because such cutting tools are generally known in the art, they will not be described in further detail here. Furthermore, it should be noted that this invention encompasses the use of any suitable cutting tool having any configuration.

For the purposes of this invention, and in order to reduce rotation of the tool sleeve 114 within the block bore 124 during use, the rotation limitation member 116 is placed in an engaging relationship between the rearward portion 132 of the tool sleeve 114 and the support block bore 124 so as to engage a sleeve engagement surface of the tool sleeve 114 and a block engagement surface of the block bore 124. In the embodiment shown, the block engagement surface is that portion of the block bore 124 in contact with the rotation limitation member 116 after the tool sleeve 114 has been assembled with the support block 112. In the embodiment shown, the sleeve engagement surface is a sleeve recess 170 in the rearward portion 132 of the tool sleeve 114. While the sleeve recess 170 may have any suitable configuration, the sleeve recess 170 of this embodiment preferably is an annular depression having a cylindrical portion 172 and an inclined surface portion which, in this embodiment, is a frusto-conical portion 174 inclined so as to have a larger diameter dimension "E" towards the forward portion 128. The side wall 176 of the sleeve recess 170 adjacent the cylindrical portion 172 is radiused. Likewise, the side wall 178 adjacent the frusto-conical portion 174 is radiused.

Figure 5:
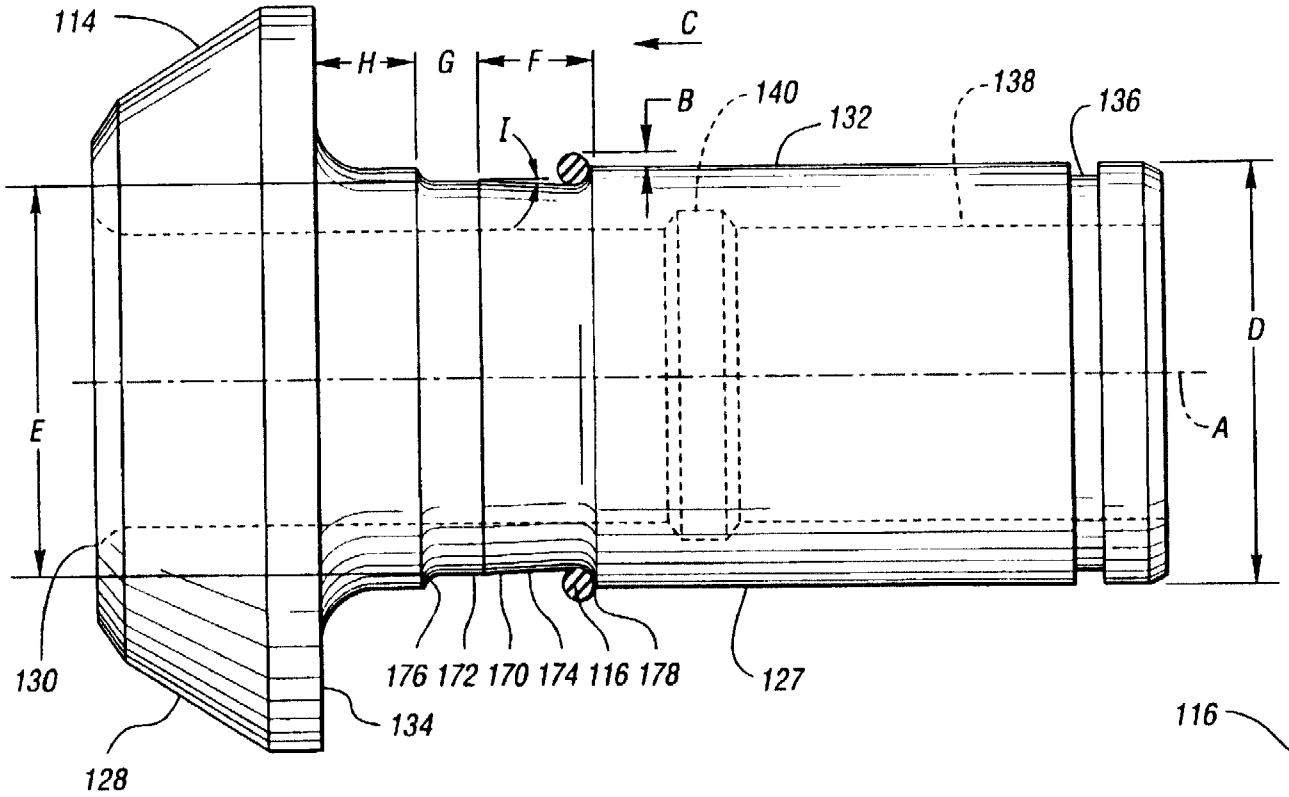
FIG. 5 is a more detailed view of the support sleeve and rotation limitation member shown in FIG. 3.
Figure 6:
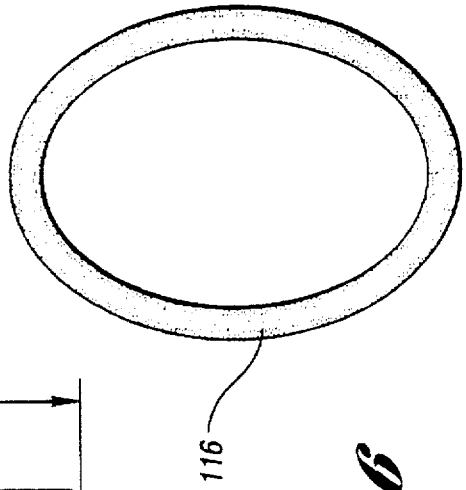
FIG. 6 is an isometric view of the rotation limitation member of FIG. 3.

While other configurations could be used, the rotation limitation member 116 of this embodiment preferably has an O-ring configuration. In other words, as shown in FIGS. 3 and 6, the rotation limitation member 116 preferably has a circular shape and a round cross-section, such as circular. It is also preferable that the rotation limitation member 116 be made of a non-metallic resilient type material such as without limitation, nylon, plastic, polymer, urethane, or nitrile rubber. The rotation limitation member 116 is preferably made from a resilient material in order to allow it to be placed over the rearward portion 132 of the tool sleeve 114 such that it may be released into the sleeve recess 170 as shown in FIG. 5 and in phantom in FIG. 3. An additional advantage of using resilient material, in addition to the advantages of being fatigue and wear resistent, is that the rotation limitation member will not be subject to corrosion. Because the moisture inherent in mining and excavating operations often contains corrosive acids, this is especially beneficial.

As best shown in FIG. 5, it is also preferable that the rotation limitation member 116 be dimensioned or have a diameter such that a portion "B" protrudes out of the sleeve recess 170, the annular depression in this embodiment, of the tool sleeve 114.

To use this embodiment, and after the rotation limitation member 116 is placed within the sleeve recess 170 as shown in FIG. 5, the rearward portion 132 of the tool sleeve 114 is inserted into the block bore 124. As the rearward portion 132 of the tool sleeve 114 is inserted into the block bore 124, the rotation limitation member 116 will engage the block bore 124 and tend to be moved or "ride up" axially in the direction "C" along the tool sleeve 114; and more specifically, axially first along the inclined surface portion, the frusto-conical portion 174, and then along cylindrical portion 172 of the sleeve recess 170 towards the forward portion 128. As a result, and as shown in FIG. 4, the rotation limitation member 116 will be compressed, in a type of camming action, between the sleeve recess 170 and the block bore 124 which will reduce or prevent rotation of the tool sleeve 114. More specifically, the rotation in this embodiment is reduced by the frictional engagement of the rotation limitation member 116 with the tool sleeve 114 and the block bore 124. Compression of the rotation limitation member 116 acts to increase the frictional engagement and reduce rotation of the tool sleeve 114 within the block bore 124 even further. Such reduction of rotation may act to preclude rotation entirely during use.

When the tool sleeve 114 is removed from the block bore 124, the rotation limitation member 116 will conversely tend to be moved axially in a direction opposite the direction "C" along the tool sleeve 114. As a result, when the tool sleeve 114 is removed completely from the block bore 124, the rotation limitation member 116 will tend to be situated at the bottom of the inclined surface portion, in this embodiment the frusto-conical portion 174, of the sleeve recess 170, such as in the position shown in FIG. 5.

For use with a support block 112 having a block bore 124 diameter of approximately 2.00", a tool sleeve 114 having the approximate dimensions set forth in the following table, and referenced in FIG. 5, has been found to be suitable.

| | |
|---|---|
| D | 1.97" |
| E | 1.87" |
| F | 0.38" |
| G | 0.25" |
| H | 0.72" |

When utilizing a tool sleeve 114 having the dimensions set forth above, it is preferable that the frusto-conical portion 174 have an angle "T" of approximately 7°, that the side wall 176 have a radius of approximately 0.12", and that the side wall 178 have a radius of approximately 0.12". In such case, it is also preferable that the rotation limitation member 116 be an O-ring, and if made from nitrile rubber that it preferably have a free diameter of approximately 1.42" (size: −221), although free diameters in the range of 1.36" to 1.73" (sizes: −220 to −224) may perform adequately, and have a cross-sectional diameter of approximately 0.139".

Figure 1:
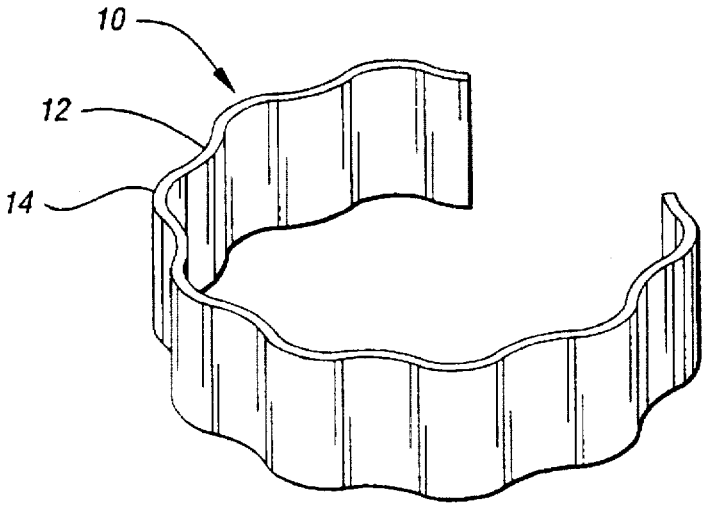
Fig. 1 (PRIOR ART)
FIG. 1 is an isometric view of a prior art steel clip.
Figure 2:
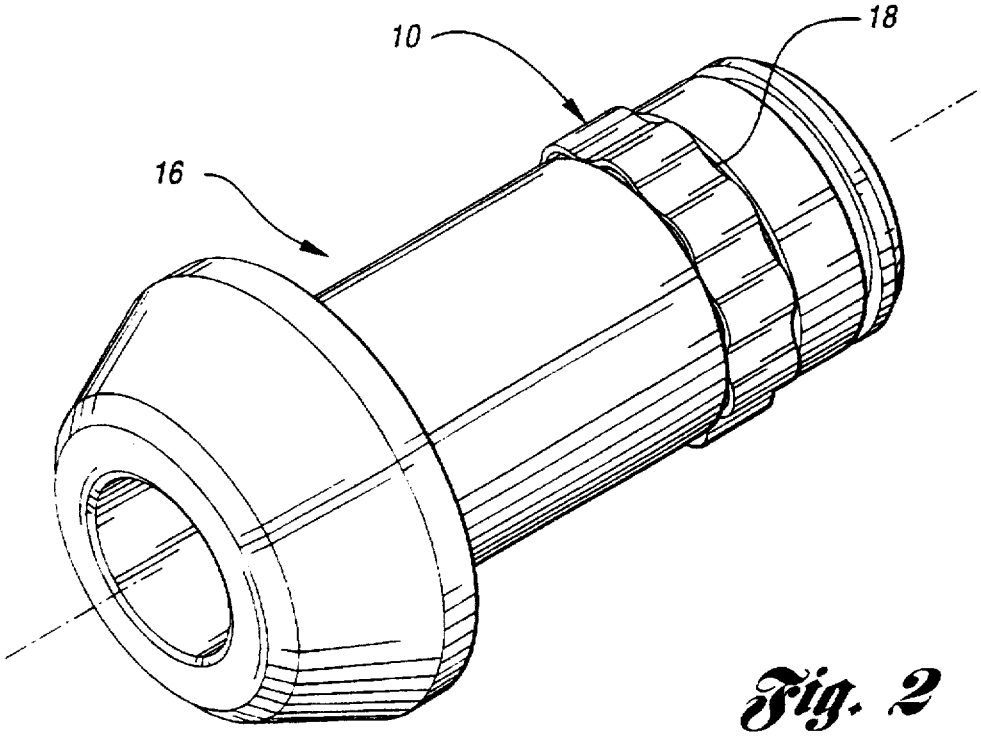
Fig. 2 (PRIOR ART)
FIG. 2 is an isometric view of a prior art support sleeve utilizing the prior art steel clip shown in FIG. 1.
Figure 7:
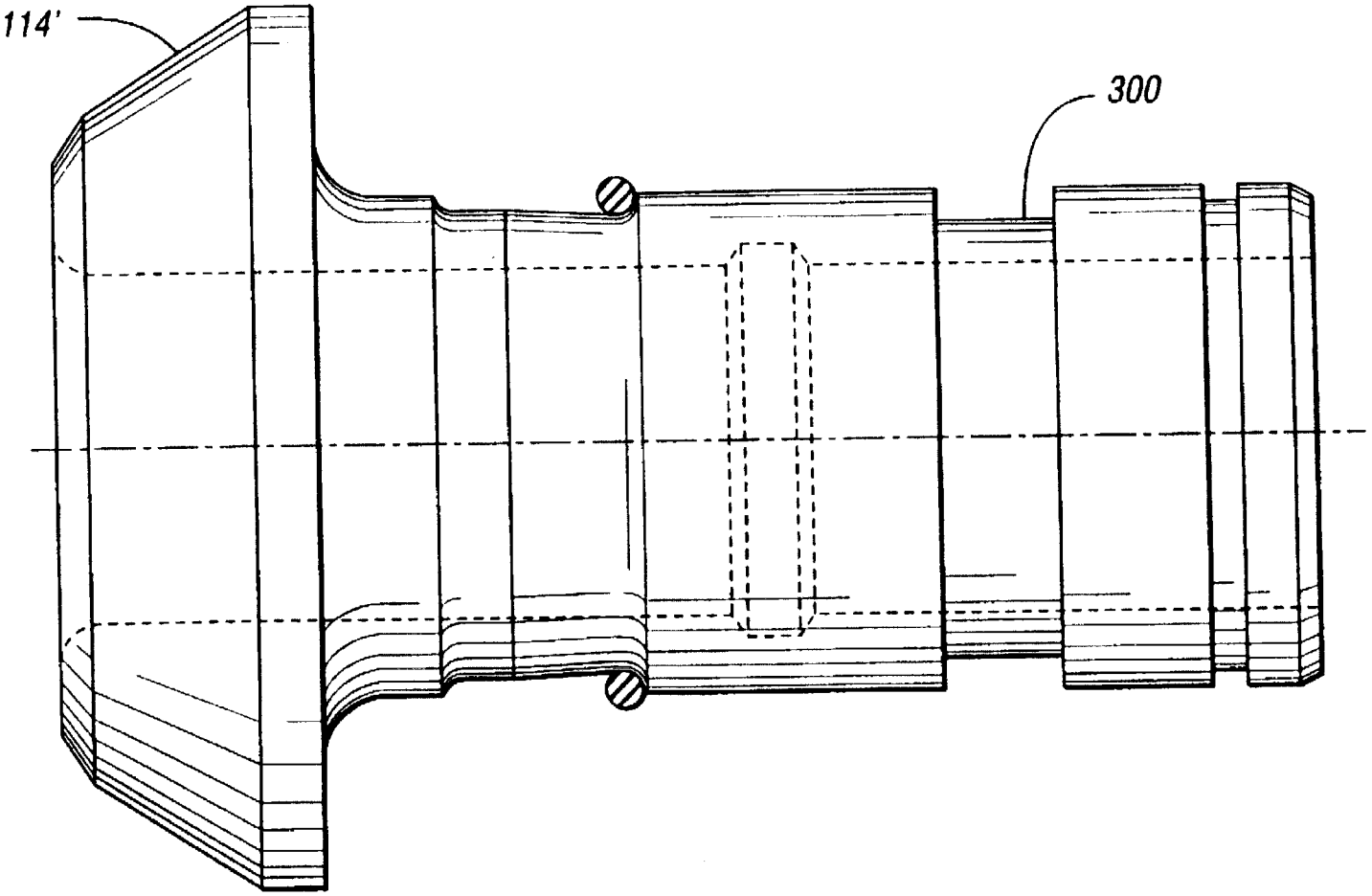
FIG. 7 is a more detailed view of an alternative support sleeve and rotation limitation member similar to that shown in FIG. 5.

FIG. 7 shows an alternative embodiment of the tool sleeve of this invention. In this embodiment, the tool sleeve 114' is identical to the tool sleeve 114 shown in FIG. 5 except that the tool sleeve 114' has an additional sleeve engagement surface, that being the sleeve recess 300 in the rearward portion 132' of the tool sleeve 114' in which another type of a rotation limitation member, such as the steel clip 10 shown in FIG. 2, may be used to further, or to alternatively, reduce or impede rotation.

While particular embodiments of the invention have been illustrated and described, it will be obvious to those skilled in the art that an infinite variety of changes and modifications may be made without departing from this invention. For example, and without limitation, the resilient rotation limitation members can have any configuration or dimensions found suitable. Also, the sleeve recess need not be an annular depression, but could have any suitable configuration. Furthermore, the rotation limitation members could be made from any suitable material. It is intended that the following claims cover all such modifications and all equivalents that fall within the spirit of this invention.

What is claimed is:

1. A tool sleeve rotation limitation system for reducing the rotation of a tool sleeve within a support block bore of a support block, the tool sleeve having a forward portion and a rearward portion, the tool sleeve rotation limitation system comprising:

a rotation limitation member located in an engaging relationship between the rearward portion of the tool sleeve and the block bore such that the rotation limitation member will be moved axially along the rearward portion of the tool sleeve as the tool sleeve is inserted into the block bore so as to engage the block bore and the rearward portion of the tool sleeve and reduce rotation of the tool sleeve within the block bore.

2. The tool sleeve rotation limitation system of claim 1 wherein the rotation limitation member is made from a resilient material.

3. The tool sleeve rotation limitation system of claim 2 wherein the rotation limitation member has an O-ring configuration.

4. A tool sleeve rotation limitation system for reducing the rotation of a tool sleeve within a support block bore of a support block, the tool sleeve rotation limitation system comprising:

a sleeve body having a sleeve recess, and a rotation limitation member located in an engaging relationship between the sleeve recess of the tool sleeve and the block bore such that the rotation limitation member will be moved axially within the sleeve recess as the tool sleeve is inserted into the block bore so as to engage the sleeve recess of the tool sleeve and the block bore and reduce rotation of the tool sleeve within the block bore.

5. The tool sleeve rotation limitation system of claim 4 wherein the rotation limitation member is made from a resilient material.

6. The tool sleeve rotation limitation system of claim 4 wherein the sleeve recess is an annular depression.

7. The tool sleeve rotation limitation system of claim 6 wherein the sleeve body has a forward portion and a rearward portion and the annular depression is in the rearward portion.

8. The tool sleeve rotation limitation system of claim 7 wherein the rotation limitation member has an O-ring configuration.

9. The tool sleeve rotation limitation system of claim 7 wherein the annular depression has an inclined surface portion such that the rotation limitation member will be moved axially within the annular depression along the inclined surface portion as the tool sleeve is inserted into the block bore and be compressed between the block bore and the rearward portion of the tool sleeve so as to reduce rotation of the tool sleeve within the block bore.

10. The tool sleeve rotation limitation system of claim 9 wherein the inclined surface portion is a frusto-conical portion.

11. The tool sleeve rotation limitation system of claim 10 wherein the rotation limitation member protrudes out of the annular depression such that the rotation limitation member will engage the block bore when the tool sleeve is inserted into the block bore.

12. The tool sleeve rotation limitation system of claim 11 wherein the rotation limitation member has an O-ring configuration.

13. The tool sleeve rotation limitation system of claim 7 wherein the annular depression has a cylindrical portion and a frusto-conical portion, the cylindrical portion being closer to the forward portion than the frusto-conical portion and the frusto-conical portion having a large diameter dimension closer to the forward portion, such that the rotation limitation member will be moved axially within the annular depression and along the frusto-conical portion as the tool sleeve is inserted into the block bore and be compressed between the annular depression and the block bore so as to reduce rotation of the tool sleeve within the block bore.

14. The tool sleeve rotation limitation system of claim 13 wherein the rotation limitation member protrudes out of the annular depression such that the rotation limitation member will engage the block bore when the tool sleeve is inserted into the block bore.

15. The tool sleeve rotation limitation system of claim 14 wherein the rotation limitation member has an O-ring configuration.

16. A tool sleeve for use with a rotation limitation member so as to reduce the rotation of the tool sleeve within a support block bore of a support block, the tool sleeve comprising:

a sleeve body having a forward portion and a rearward portion, the rearward portion having an annular depression which has an inclined surface portion such that a rotation limitation member located within the annular depression will protrude from and engage the block bore as the tool sleeve is inserted into the block bore such that the rotation limitation member will be moved axially along the inclined surface portion and be compressed between the annular depression and the block bore so as to reduce rotation of the tool sleeve within the block bore.

17. The tool sleeve of claim 16 wherein the inclined surface portion is a frusto-conical portion.

18. The tool sleeve of claim 17 wherein the annular depression includes a cylindrical portion.

19. The tool sleeve of claim 18 wherein the cylindrical portion is closer to the forward portion than the frusto-conical portion and the frusto-conical portion has a larger diameter dimension closer to the forward portion.

20. The tool sleeve of claim 19 wherein the annular depression has sidewalls which are radiused.

* * * * *